US009457283B2

(12) United States Patent
Martinez

(10) Patent No.: US 9,457,283 B2
(45) Date of Patent: Oct. 4, 2016

(54) ACTION FIGURINE WITH ACCESSORIES AND APPARATUS AND METHOD FOR SECURING ACCESSORIES THERETO

(71) Applicant: Ruben L. Martinez, Whittier, CA (US)

(72) Inventor: Ruben L. Martinez, Whittier, CA (US)

(73) Assignee: Mattel, Inc., El Segundo, CA (US)

( * ) Notice: Subject to any disclaimer, the term of this patent is extended or adjusted under 35 U.S.C. 154(b) by 559 days.

(21) Appl. No.: 13/715,015

(22) Filed: Dec. 14, 2012

(65) Prior Publication Data

US 2013/0189899 A1 Jul. 25, 2013

Related U.S. Application Data

(60) Provisional application No. 61/576,690, filed on Dec. 16, 2011.

(51) Int. Cl.

| | |
|---|---|
| ***A63H 33/00*** | (2006.01) |
| ***A63H 3/50*** | (2006.01) |
| ***A63H 3/52*** | (2006.01) |

(52) U.S. Cl.

CPC . *A63H 3/50* (2013.01); *A63H 3/52* (2013.01)

(58) Field of Classification Search

USPC ..... 446/376, 487, 75, 308–312; 206/335, 206/775, 527

See application file for complete search history.

(56) References Cited

U.S. PATENT DOCUMENTS

| | | | | | |
|---|---|---|---|---|---|
| 1,041,573 | A | * | 10/1912 | Baring-Gould | 40/486 |
| 1,188,864 | A | * | 6/1916 | Webber | 446/366 |
| 1,262,998 | A | * | 4/1918 | Sumner | 446/152 |
| 1,323,669 | A | * | 12/1919 | Allstatter | 446/366 |
| 2,334,008 | A | * | 11/1943 | Ischinger | 434/398 |
| 2,573,625 | A | * | 10/1951 | Swart | 40/422 |
| 3,392,823 | A | * | 7/1968 | Green et al. | 206/777 |
| 4,026,066 | A | * | 5/1977 | Reiner et al. | 446/236 |
| 4,118,888 | A | * | 10/1978 | Ogawa | A63H 33/26 124/16 |
| 4,165,579 | A | | 8/1979 | Chase | |
| 4,206,564 | A | * | 6/1980 | Ogawa | A63H 33/003 446/94 |
| 4,234,079 | A | * | 11/1980 | Otake | 206/459.1 |
| 4,261,133 | A | | 4/1981 | Hanson et al. | |
| 4,263,741 | A | * | 4/1981 | Koshiya | 446/291 |
| 4,360,988 | A | | 11/1982 | Schoenfield et al. | |
| 4,407,083 | A | * | 10/1983 | Hartgrave | 40/414 |
| 4,412,399 | A | * | 11/1983 | Abe et al. | 446/359 |
| 4,536,164 | A | * | 8/1985 | Klawitter | 446/143 |
| 4,595,378 | A | | 6/1986 | Sweet et al. | |
| 4,723,931 | A | | 2/1988 | Allen et al. | |
| 4,738,647 | A | | 4/1988 | Renger et al. | |
| 4,961,716 | A | | 10/1990 | Hippely et al. | |
| 5,172,806 | A | * | 12/1992 | Mickelberg | 206/756 |
| 5,188,222 | A | * | 2/1993 | Pierce | 206/756 |

(Continued)

*Primary Examiner* — Michael Dennis
*Assistant Examiner* — Urszula M Cegielnik
(74) *Attorney, Agent, or Firm* — Sheppard, Mullin, Richter & Hampton LLP

(57) ABSTRACT

A toy having: an action figurine; an accessory configured to be removably secured to the action figurine; and a housing into which the action figurine and the accessory can be inserted, wherein the housing is configured to releasably retain the accessory and the action figurine therein after they have been inserted into the housing, the housing further comprising: a first actuation mechanism for releasing the action figurine from the housing when the first actuation mechanism is actuated, wherein the action figurine becomes dislodged from the accessory, and the accessory remains within the housing; and a second actuation mechanism for releasing both the action figurine and the accessory from the housing when the second actuation mechanism is actuated.

19 Claims, 13 Drawing Sheets

(56) References Cited

U.S. PATENT DOCUMENTS

| | | | | |
|---|---|---|---|---|
| 5,289,916 | A * | 3/1994 | Mickelberg | 206/756 |
| 5,328,400 | A | 7/1994 | Bass | |
| 5,494,252 | A * | 2/1996 | Amit et al. | 248/560 |
| 5,636,741 | A * | 6/1997 | O'Keefe | 206/459.1 |
| RE35,556 | E | 7/1997 | Weinreich | |
| 5,718,335 | A * | 2/1998 | Boudreaux | 206/461 |
| 5,871,385 | A | 2/1999 | Hippely et al. | |
| 5,919,074 | A * | 7/1999 | Honda | 446/268 |
| 6,409,568 | B1 * | 6/2002 | Søgaard et al. | 446/73 |
| 6,727,826 | B1 * | 4/2004 | Ki Kwan et al. | 340/12.3 |
| 7,318,766 | B2 * | 1/2008 | Marine et al. | 446/359 |
| 7,371,148 | B2 | 5/2008 | Marine et al. | |
| 7,448,932 | B2 | 11/2008 | Buckley et al. | |
| 7,603,802 | B2 * | 10/2009 | Oudekerk et al. | 40/375 |
| 7,950,979 | B2 | 5/2011 | Barthold | |
| 2002/0106624 | A1 * | 8/2002 | Chan | 434/393 |
| 2006/0118461 | A1 * | 6/2006 | Calendrille, Jr. | 206/779 |
| 2006/0270314 | A1 * | 11/2006 | Campbell | A63H 33/003 446/431 |
| 2007/0093171 | A1 | 4/2007 | Chan et al. | |
| 2010/0041301 | A1 | 2/2010 | Phillips | |
| 2010/0255753 | A1 | 10/2010 | Norman et al. | |
| 2011/0111669 | A1 | 5/2011 | Chan et al. | |

* cited by examiner

ACTION FIGURINE WITH ACCESSORIES AND APPARATUS AND METHOD FOR SECURING ACCESSORIES THERETO

CROSS REFERENCE TO RELATED APPLICATIONS

This application claims the benefit of U.S. Provisional Patent Application Ser. No. 61/576,690, filed Dec. 16, 2011, the contents of which are incorporated herein by reference thereto.

BACKGROUND

Various embodiments of the present invention relate to a toy and more particularly, a toy figurine having articulating portions and accessory items removably secured to the toy figure.

Children's toys have included miniature cars, boats, trains, figures, etc. wherein the user's imagination provides for hours of extended play and enjoyment. Toy figures that resemble fighting or combat type activities are particularly popular as the user can participate in imaginary battles or action sequences.

Accordingly, it is desirable to provide a toy that has accessory features and allows securement of the same to the accessory in a unique manner.

SUMMARY OF THE INVENTION

In one embodiment, a toy is provided. The toy having: an action figurine; an accessory configured to be removably secured to the action figurine; and a housing into which the action figurine and the accessory can be inserted, wherein the housing is configured to releasably retain the accessory and the action figurine therein after they have been inserted into the housing, the housing further comprising: a first actuation mechanism for releasing the action figurine from the housing when the first actuation mechanism is actuated, wherein the action figurine becomes dislodged from the accessory, and the accessory remains within the housing; and a second actuation mechanism for releasing both the action figurine and the accessory from the housing when the second actuation mechanism is actuated.

In another embodiment, the combination of an action figurine, an accessory configured to be removably secured to the action figurine; and a housing into which the action figurine and the accessory can be inserted, wherein the housing is configured to releasably retain the accessory and the action figurine therein after they have been inserted into the housing, the housing further comprising: a first means for releasing only the action figurine from the housing when the first actuation button is depressed and the action figurine and the accessory have been previously inserted into the housing; and a second means for releasing both the action figurine and the accessory from the housing when the second actuation button is depressed and the action figurine and the accessory have been previously inserted into the housing.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

Figure 1C:
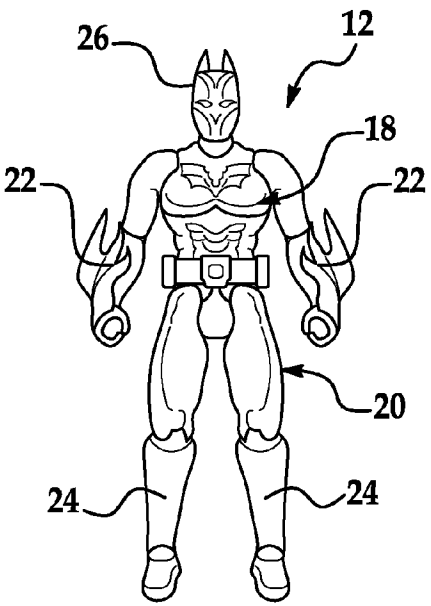
FIGS. 1A-1C are views of a toy in accordance with an exemplary embodiment of the present invention.
Figure 1B:
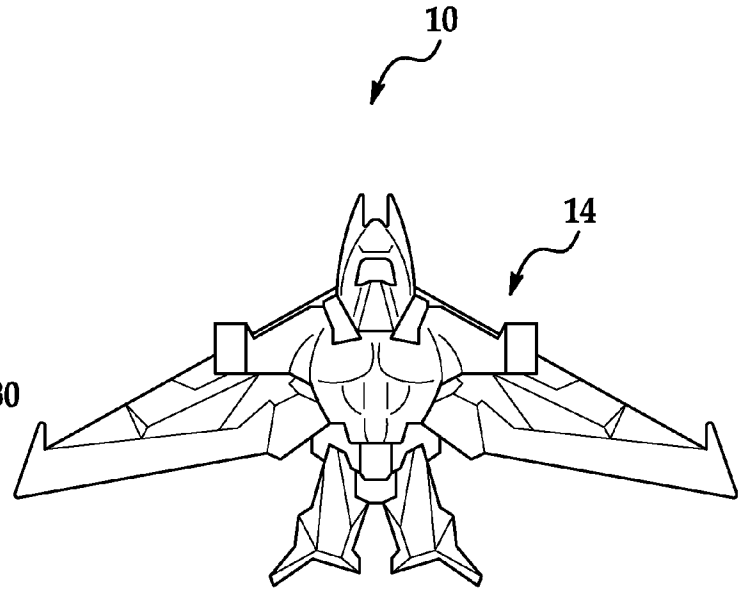
Figure 1A:
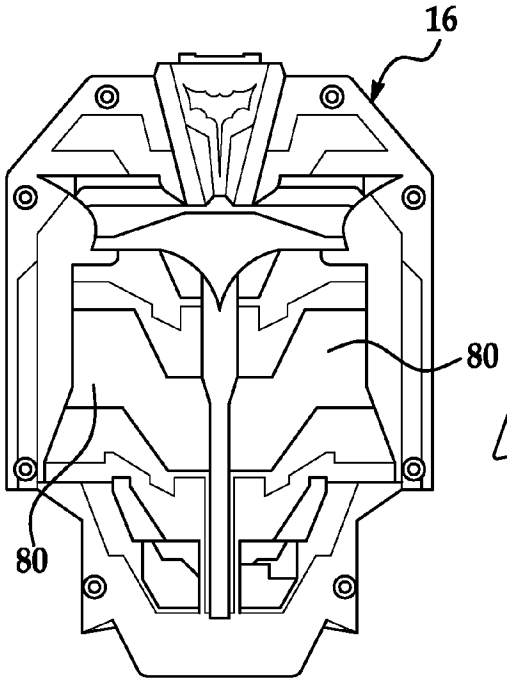
Figure 2:
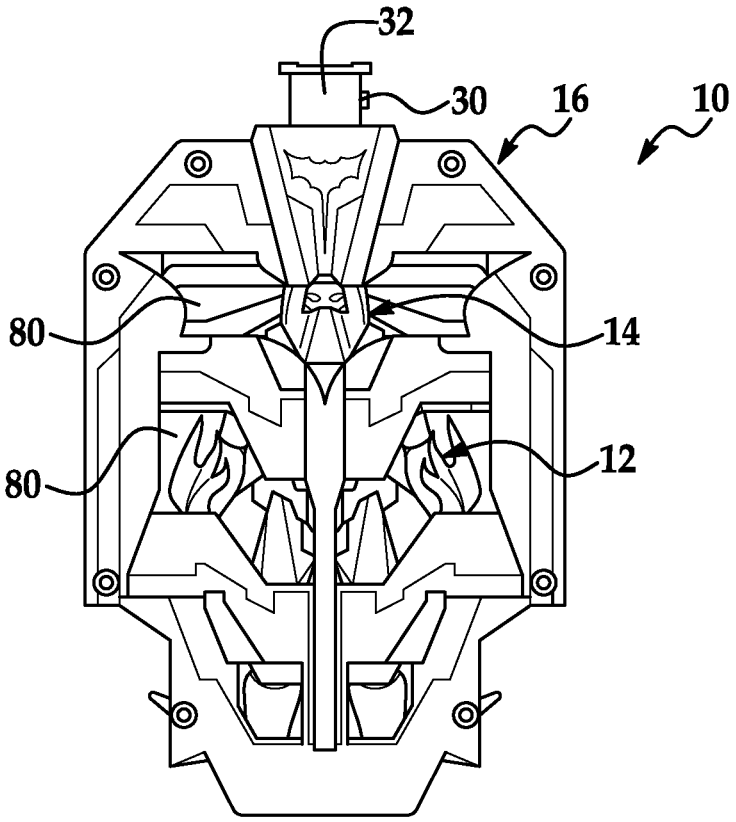
FIG. 2 is an assembled view of the toy illustrated in FIGS. 1A-1C
Figure 3A:
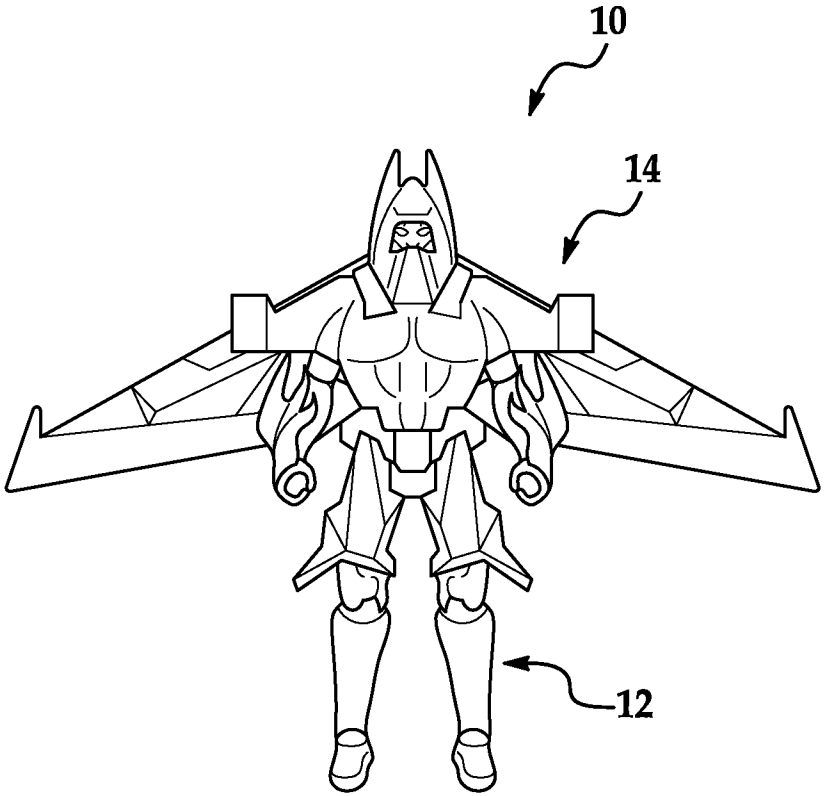
FIGS. 3-5 are other views of the toy in accordance with an exemplary embodiment of the present invention.
Figure 3:
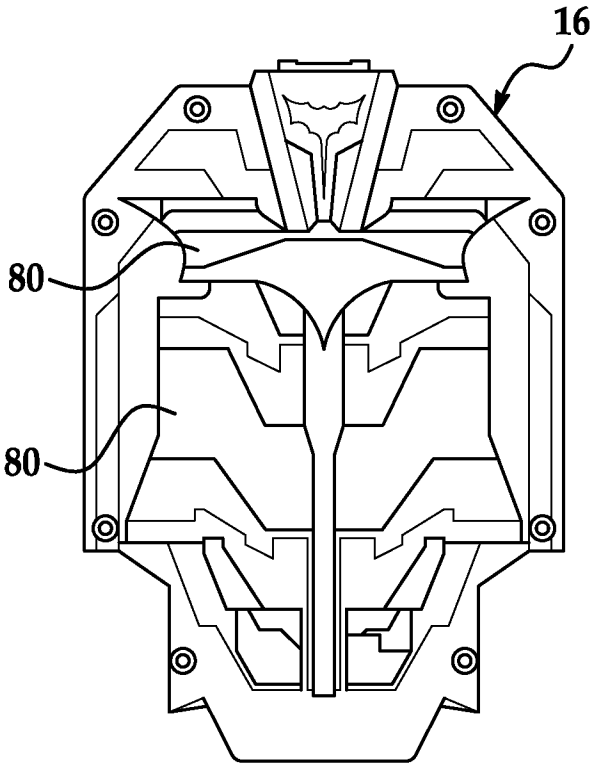
Figure 4:
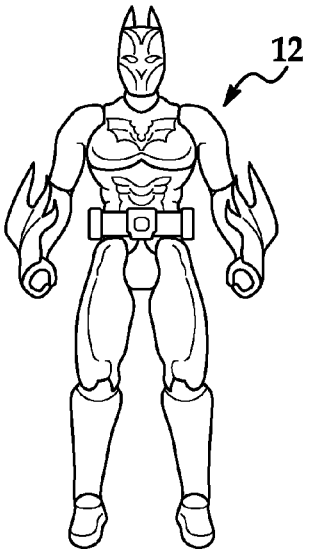
Figure 4A:
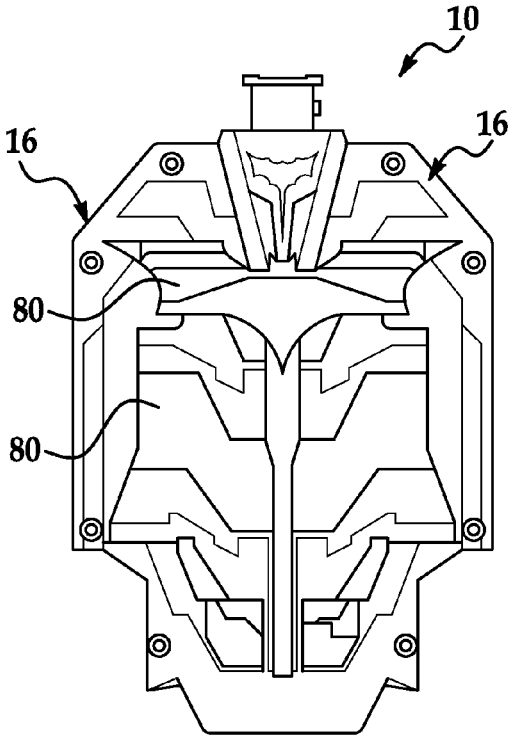
Figure 5:
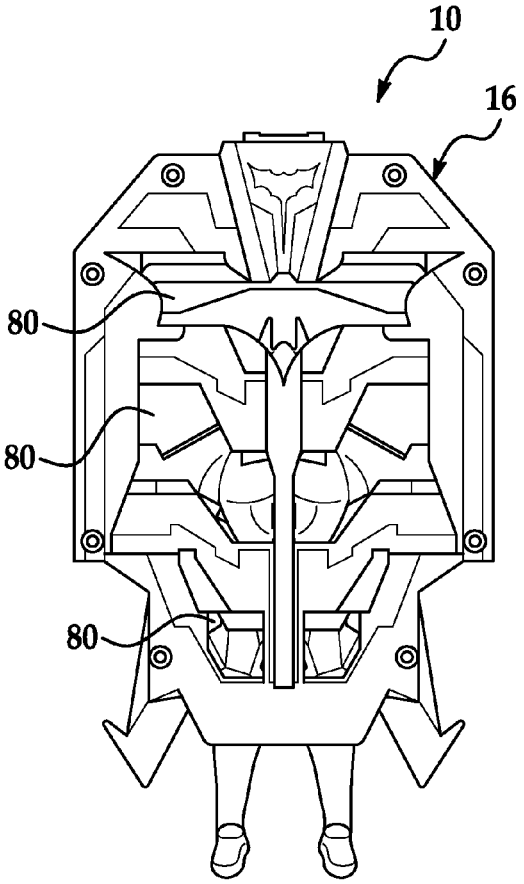

Although the drawings represent varied embodiments and features of the present invention, the drawings are not necessarily to scale and certain features may be exaggerated in order to illustrate and explain exemplary embodiments the present invention. The exemplification set forth herein illustrates several aspects of the invention, in one form, and such exemplification is not to be construed as limiting the scope of the invention in any manner.

DETAILED DESCRIPTION

Referring now to FIGS. 1A-11R, various exemplary embodiments of a toy 10 are illustrated. In accordance with these exemplary embodiments, portions of the toy 10 as described herein may be formed out of an easily molded material such as plastic or any other equivalent materials. As will be further discussed herein, the toy 10 can be configured into various configurations.

In one embodiment, toy 10 includes an action figurine 12 and an accessory 14 configured to be removably secured to the action figurine 12. Non-limiting examples of accessory 14 include but are not limited to wings, back packs, weapons, armor, flight apparatus, cowls, caps, costumes, etc. The accessory 14 is configured to be releasably secured to the action figurine 12 via a securement device or housing 16. In one non-limiting embodiment, the action figurine 12 will resemble a human, humanoid, robot, theme character or any other type of configuration. Action figurine 12 has an upper body portion 18 and a lower body portion 20. The upper body portion 16 has a pair of arms or appendages 22 movably secured thereto and the lower body portion 20 has a pair of legs or appendages 24 that are movably secured to the lower body portion 20. It is, of course, understood that the pair of arms 22 and pair of legs 24 may be movably secured to any portion of the action figurine 12. Still further, each of the arms or legs can be further configured with a pivoting joint (e.g., elbow or knee) such that further movement of the same can be provided such that the action figurine may be manipulated into numerous configurations. Alternatively, the action figurine 12 can be molded as a solid unitary structure.

The pair of arms 22 and the pair of legs 24 are movably or pivotally secured to the action figurine 12 at a joint. For example, one non-limiting configuration of the joint is a ball and socket arrangement wherein the ball is insertable into the socket to allow movement therein. Of course, numerous other equivalent joints are contemplated to be within the scope of the various embodiments of the present invention including non-articulating limbs or appendages.

The action figurine 12 also has a head portion 26. As mentioned above, the toy 10 also includes at least one accessory 14 that is configured to be removably secured to the action figurine 12. In one implementation, the accessory 14 is configured to be secured to the action figurine 12 via releasable engagement with the head portion 26. Of course, the accessory 14 can be configured to removably engage other portions (e.g., torso, shoulders, arms, waist, legs, etc. or any combination thereof) of the action figurine that do not include the head portion 26.

Housing 16 is configured to have an opening 28 into which the action figurine 12 and the accessory 14 can be inserted. The housing 16 is configured to releasably retain the accessory 14 and the action figurine 12 therein after they have been inserted into the housing via opening 28. In one mode of operation, the housing 16 is configured to releasably retain both the action figurine 12 and the accessory 14 therein. In another mode of operation, the housing 16 is configured to releasably retain the accessory 14 while allowing the action figurine 12 to be removed therefrom.

In order to provide this feature, the housing 16 has a first actuation button 30 for releasing only the action figurine 12 from the housing 16 when the first actuation button 30 is depressed. Manipulation of the first actuation button 30 causes the action figurine 12 to become dislodged from the accessory 14, and the accessory 14 remains within housing 16. In one embodiment, the action figurine 12 will be released from the housing 16 upon actuation of the first actuation button 30. The housing 16 also has a second actuation button 32 for releasing the accessory 14 along with the action figurine 12, if the action figurine 12 is present, from the housing 16 when the second actuation button 32 is depressed. Manipulation of the second actuation button 32 causes the accessory 14 and the action figurine 12 to be dislodged or removed from an interior cavity 36 of the housing 16. Still further and if only the accessory 14 is received within the housing 16 actuation of button 32 will cause the same to be dislodged or removed from the interior cavity 36 of the housing 16. In similar fashion and if only the action figurine 12 is in the housing actuation of button 30 will cause the same to be dislodged or removed from the interior cavity 36 of the housing 16. FIG. 8B provides an illustration wherein only the accessory 14 is received within the interior cavity 36 of the housing 16.

Accordingly, the toy 10 through the use of housing 16 allows a user to insert an action figurine 12 with a first configuration (e.g., no accessory 14 applied) into the housing 16, which in this configuration has accessory 14 located within the interior cavity 36 of the housing 16. Once the action figurine 12 is fully inserted therein, a user simply depresses the second actuation button 32 and the action figurine 12 is released from the housing having a second, different configuration (e.g., accessory 14 now applied to the action figurine 12).

Accordingly, the toy 10 will give the illusion that the action figurine 12 has been transformed through its insertion into housing 16 through opening 28. Alternatively, the action figurine 12 with accessory 14 secured thereto (e.g., the second configuration) is inserted into the interior cavity 36 of the housing 16. Here and in order to change from the second configuration to the first configuration, a user simply manipulates or pushes the first actuation button 32 such that only the action figurine 12 is released from the interior cavity 36 of the housing 16 and the accessory 14 is retained therein. Once again, the toy 10 provides the illusion that the action figurine 12 has been transformed through its insertion into housing 16. Accordingly, numerous modes of play can be provided for example, and referring to FIGS. 11A-11R numerous alternative accessories 14 can be applied to various action figurines 12.

In order to assist in the insertion of the accessory 14 and/or the action figurine 12 with accessory 14 secured thereto into the interior cavity 36 of the housing 16, a mounting portion 38 is configured to have a pair of features 40 configured to slidably engage a pair of slots 42 located within the interior cavity 36 of the housing 16. In one non-limiting embodiment, the pair of features 40 are configured to slidably engage a portion of a wall that defines the slot 42 within the interior cavity 36 of the housing 16.

Mounting portion 38 is also configured to releasably (e.g., frictionally or otherwise) engage a portion of the upper body portion 18 of the action figurine 12 as well as receive head portion 26 within a corresponding head covering portion 44 of accessory 14. Head covering portion 44 is configured to have an opening 46, which allows for contact with head portion 26 of the action figurine 12 when it is inserted into accessory 14. This feature (e.g., opening 46) allows a movable member 48 coupled to the first actuation button 32 to pass through the opening 46 and thus dislodge the action figurine 12 from the accessory 14 when they are inserted into the interior cavity 36 of the housing 16 and the first actuation button 32 is depressed downwardly. The dislodging may occur when the downward force from the first actuation button 32 and the moveable member 48 overcomes the releasable engagement (e.g. frictional force) between the upper body portion 18 and the mounting portion 38.

Movable member 48 is capable of movement between a first position and a second position within the interior cavity 36 of the housing 16. The first position of movable member 48 corresponds to the action figurine 12 being fully inserted into the interior cavity 36 of the housing such that the head member 26 of the action figurine 12 contacts the movable member 48 and pushes the first actuation 30 button upwardly away from a top surface 58 of the housing 16 while the second position of movable member 48 corresponds to depression of the first actuation button 32 with respect to surface 58 and the subsequent dislodging or removal of action figurine 12 from the interior cavity 36 of the housing (e.g., movable member 48 contacting head portion 26 of the action figurine 12).

In addition, the second actuation button 32 is coupled to a separate movable member 50 that has a receiving portion 52 configured to releasably receive and engage (e.g., frictionally or otherwise) a portion of the accessory 14, which in the illustrated example is head covering portion 44 of course, other portions of accessory 14 can be engaged by receiving portion 52 of movable member 50.

Movable member 50 is capable of movement between a first position and a second position within the interior cavity 36 of the housing 16. The first position of movable member 50 corresponds to complete insertion of the accessory 14 into housing 16 while the second position corresponds to actuation or depression of the second actuation button 32 and the dislodging or removal of the accessory 14 from the interior cavity 36 of the housing 16.

Accordingly, the accessory 14 is engaged by movable member 50 such that when the action figurine 12 and the accessory 14 are fully inserted into the interior cavity 36 of the housing 16 and the first actuation button 32 is manipulated, movable member 48 can contact a portion of the action figurine 12 (e.g., head 26 or other portion that is engaged in the portion of the accessory 14 that is releasably engaged by the movable member 50) and dislodge the same from the accessory 14 while the accessory 14 still remains engaged with movable member 50.

In addition and in order to assist with the disengagement of action figurine 12 from accessory 14, end portions 54 of movable member 50 are also slidably received within slots 42. Disposed within slots 42 are a pair of spring biased members 56, each having a feature configured to engage a portion of end portions 54 as they slide within slots 42 towards the first position of the movable member 50 corresponding to the complete insertion of the accessory 14 into the housing 16 such that the second actuation button 32 is positioned away from top surface 58 of the housing. Members 56 are spring biased in the direction of arrows 70 such that as the accessory 14 is inserted into the interior cavity 36 of the housing 16, movable member 50 is contacted and moved towards the first position. The movement of the movable member 50 slides the end portions 54 within slots 42 past the features of spring biased members 56 and thus provides a means for retaining movable member 50 in the first position. Additionally, movable member 50 pushes the second actuation button 32 upwardly away from the top surface 58 of the housing. Accordingly and in order to dislodge the accessory 14 from the interior cavity 36 of the housing 16 a user must depress the second actuation button 32 so that end portions 54 overcome the biasing force in the direction of arrow 70 and thus pass the spring biased members 56.

Figure 8A:
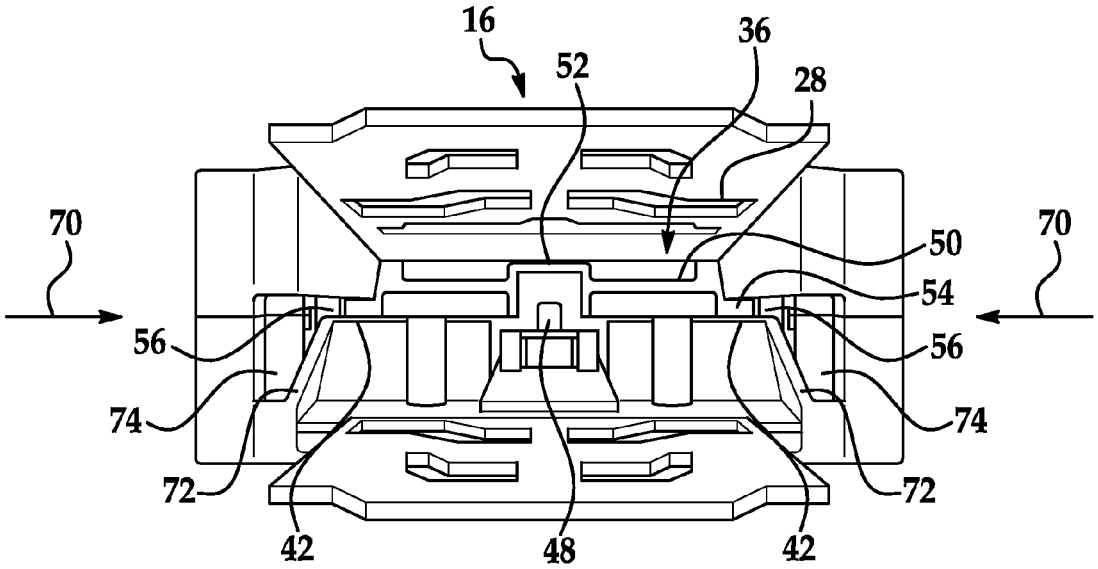
Figure 8B:
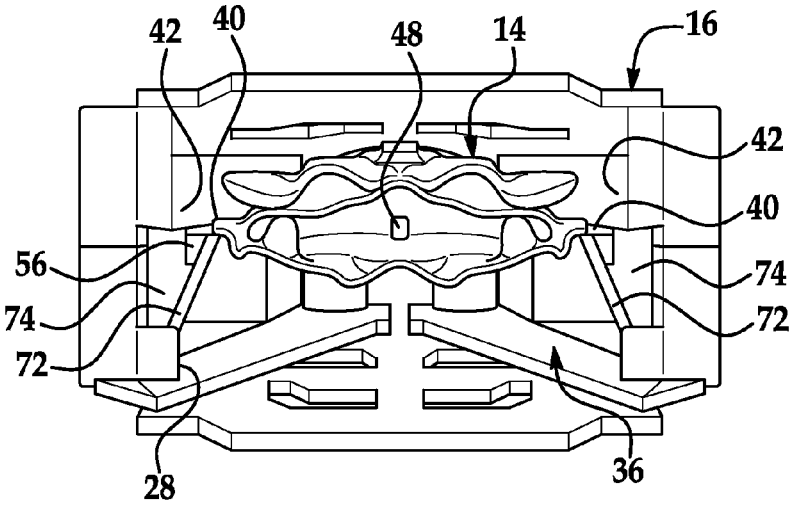
Figure 9:
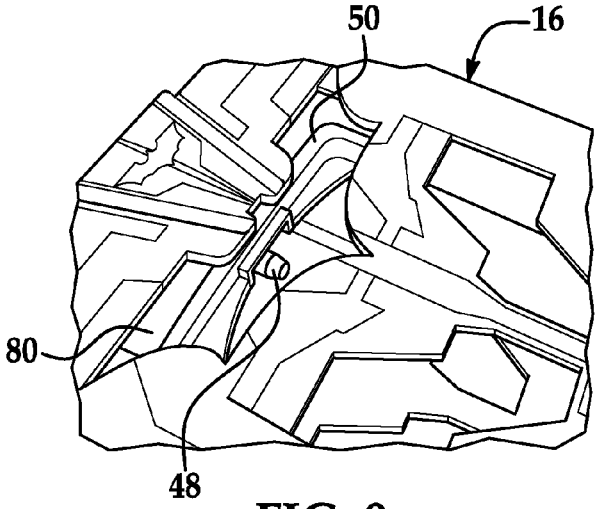
Figure 10:
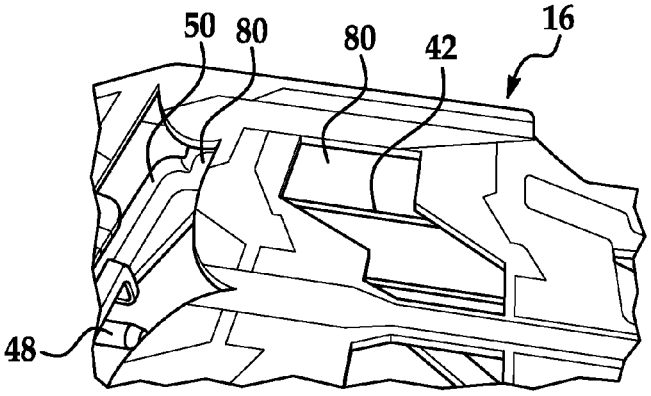

Referring to at least FIG. 8A, slots 42 are configured to have an open end proximate to opening 28 such that features 40 of accessory 14 can be slidably received within slots 42 as accessory 14 is inserted within the central cavity 36 of the housing 16. In one embodiment, the open end of the slots 42 proximate to opening 28 is enlarged in order to facilitate the insertion of features 40 of the accessory into slots 42. Still further the open end of slots 42 proximate to opening 28 are configured with cam surfaces or ramp portions 72 such that as the accessory 14 and/or the action figurine 12 with the accessory secured thereto is/are inserted into the opening 28, ramp portions or cam surfaces 72 guide features 40 into slidable engagement with slots 42. As illustrated in FIG. 8A, an enlarged opening 74 of slots 42 proximate to opening 28 is provided. This enlarged opening provides, in one embodiment, a wide mouth or guiding area for insertion of features 40 of the accessory therein.

Figure 6A:
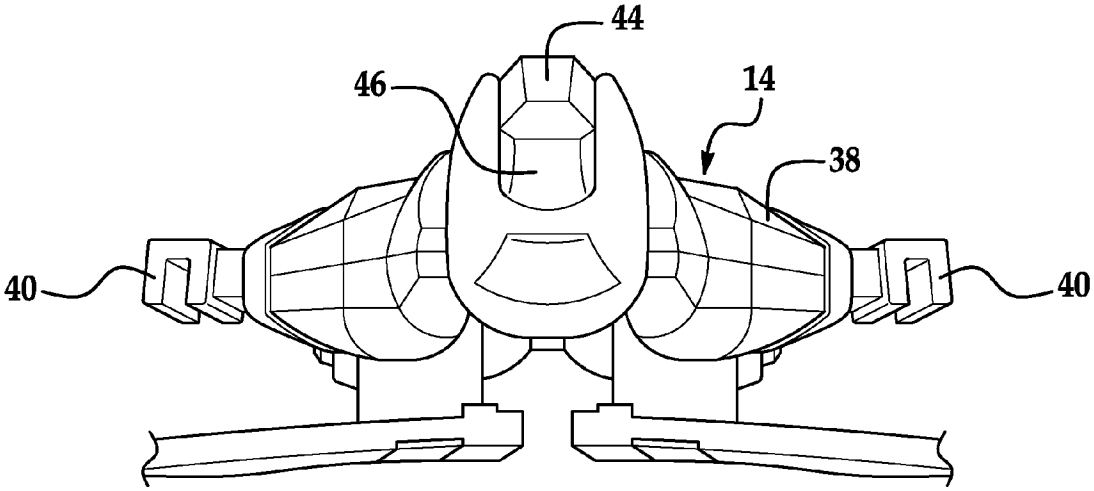
FIGS. 6A and 6B illustrate accessories for use in various embodiments of the present invention.
Figure 6B:
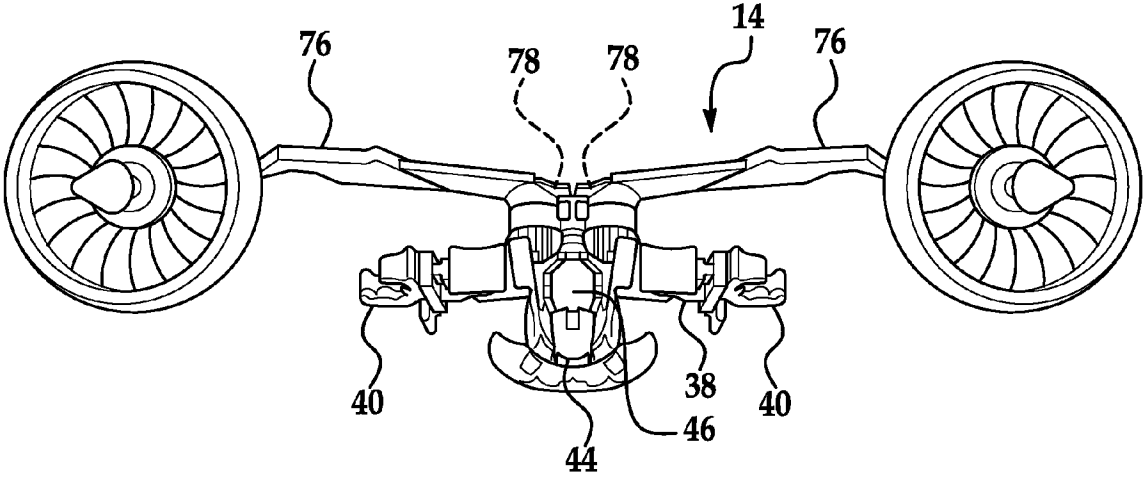
Figure 7:
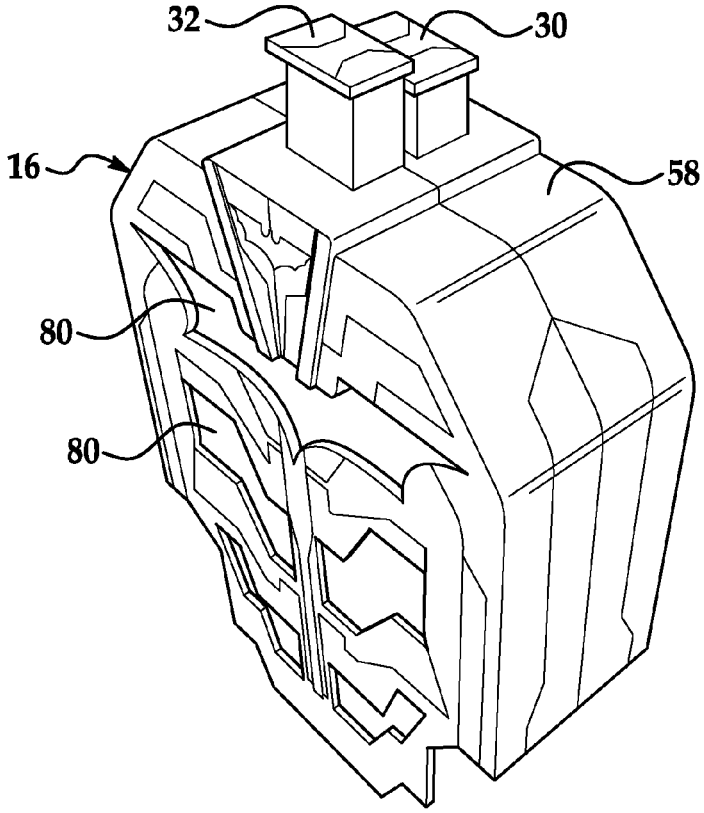
FIGS. 7-10 are various views of a housing of the toy.

Referring now to FIG. 6B and in one embodiment, the accessory 14 is configured to have a pair of deployable features 76 pivotally mounted thereto such that they can be manipulated into various positions for enhanced play. For example, a first position may correspond to the accessory being inserted into the interior cavity 36 of the housing and a second position may correspond to a configuration of the accessory that is not possible due to the confines of the interior cavity 36. In addition and in one embodiment, the pair of deployable features 76 may be spring biased into the second position by a biasing member or spring 78 such that as the accessory is inserted into the interior cavity 36 the deployable features 76 are manipulated into the first position so that the accessory 14 can be inserted into the interior cavity 36 and then the deployable features 76 will spring into the second position as the accessory 14 is removed from the interior cavity 36 of the housing 16 due to the biasing force of the springs 78. Non-limiting examples of accessory 14 include but are not limited to wings, back packs, weapons, armor, flight apparatus, cowls, caps, costumes, etc.

Figure 11A:
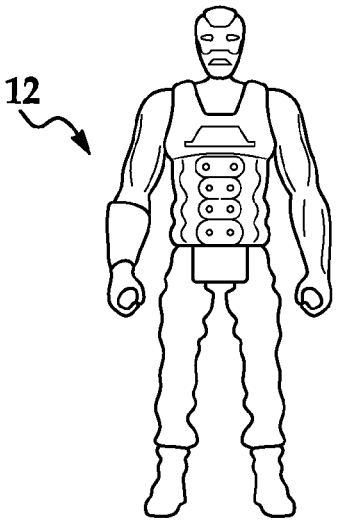
FIGS. 11A-11R illustrate alternative exemplary embodiments of the present invention.
Figure 11B:
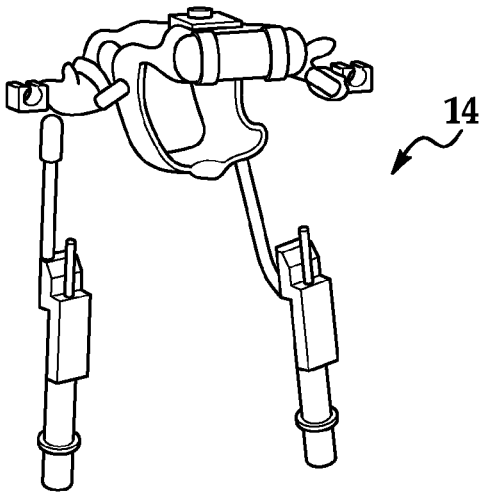
Figure 11C:
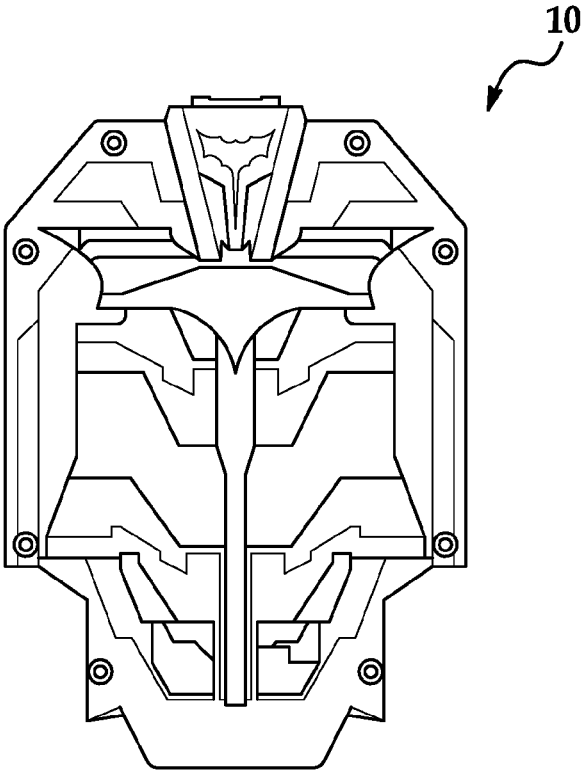
Figure 11D:
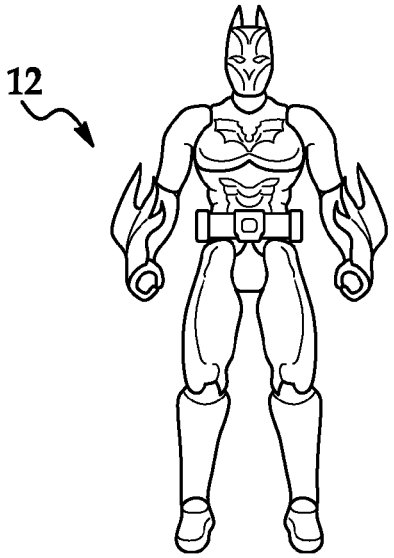
Figure 11E:
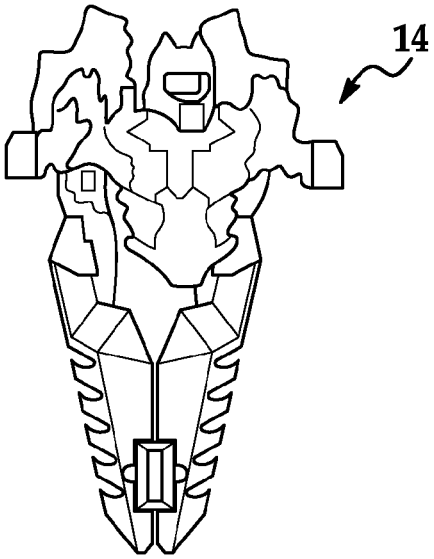
Figure 11F:
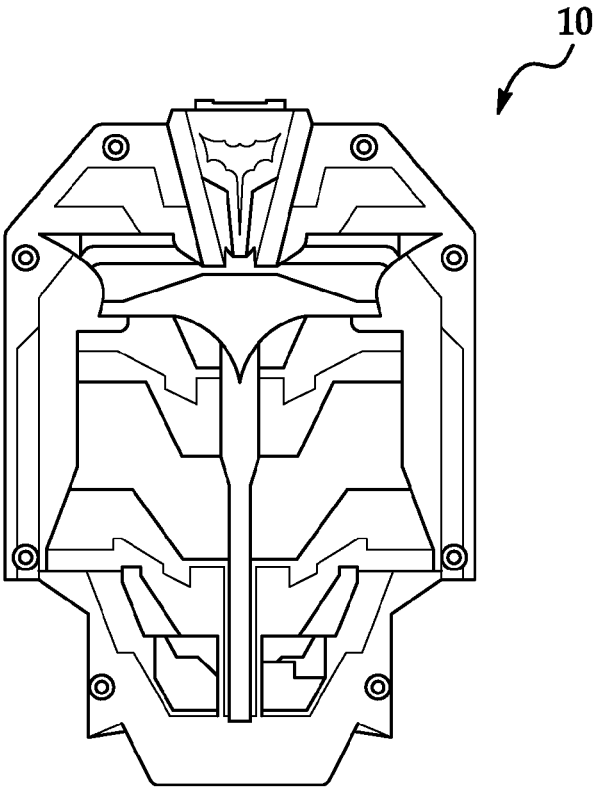
Figure 11G:
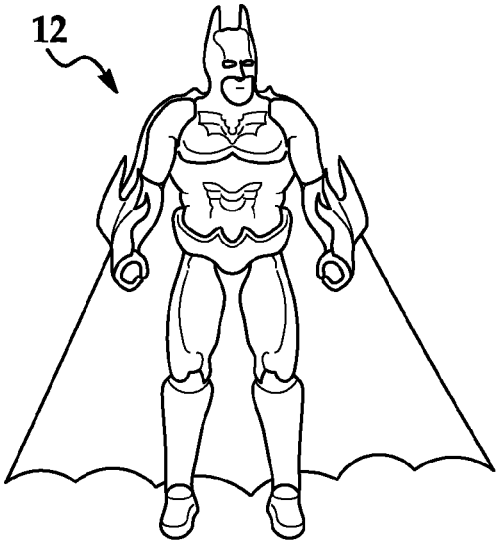
Figure 11H:
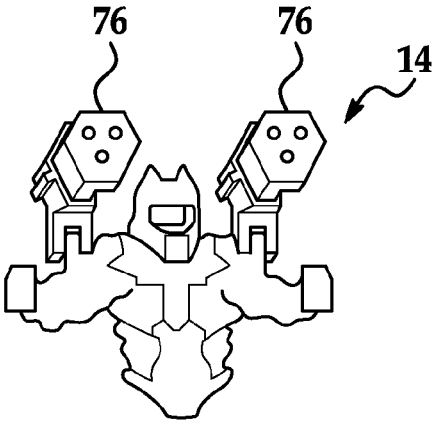
Figure 11I:
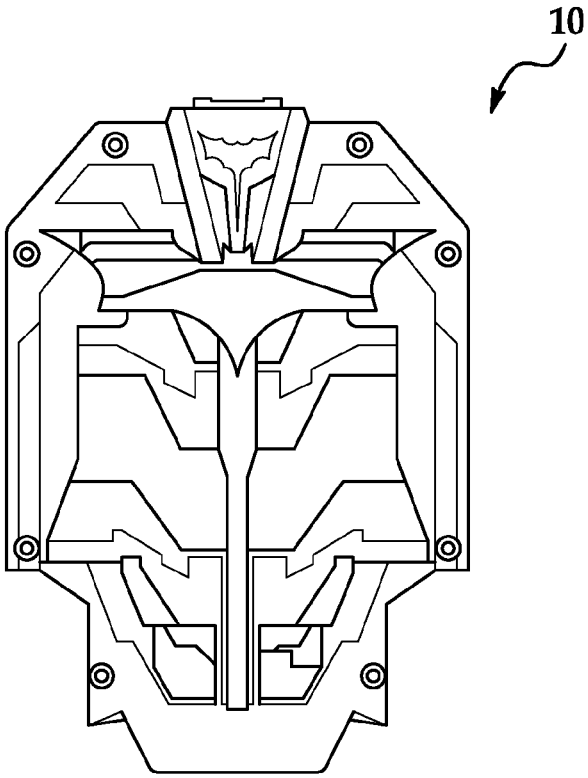
Figure 11J:
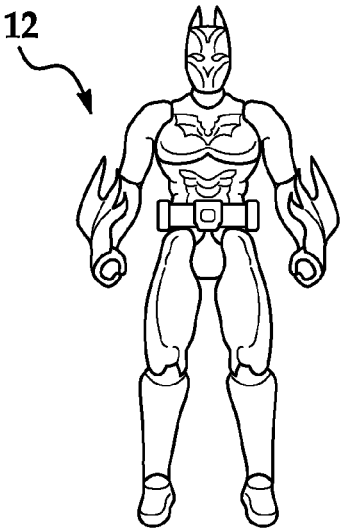
Figure 11K:
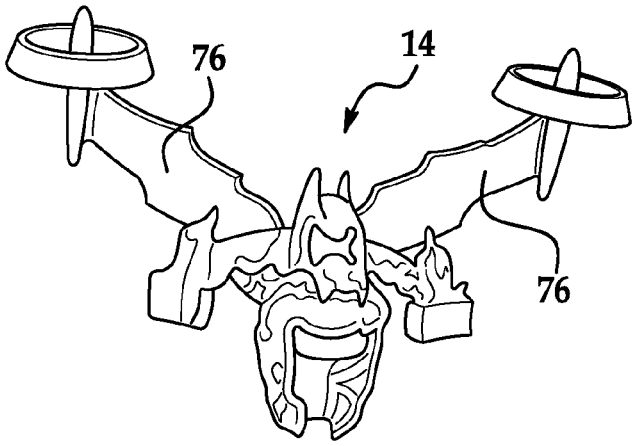
Figure 11L:
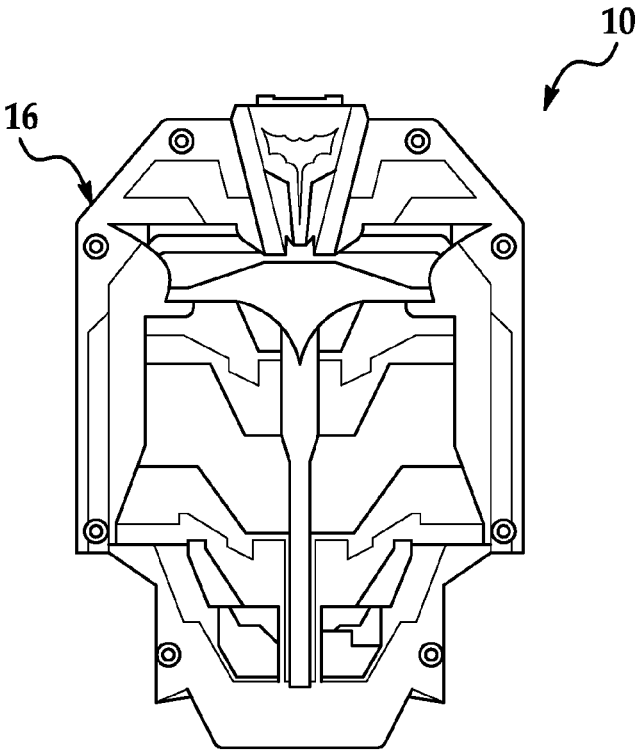
Figure 11M:
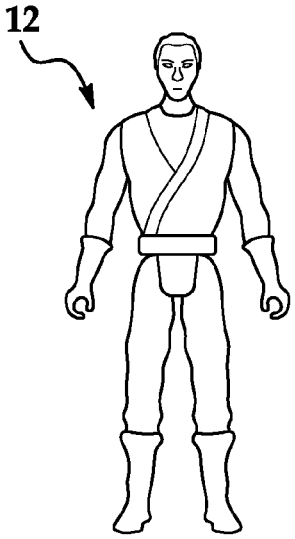
Figure 11N:
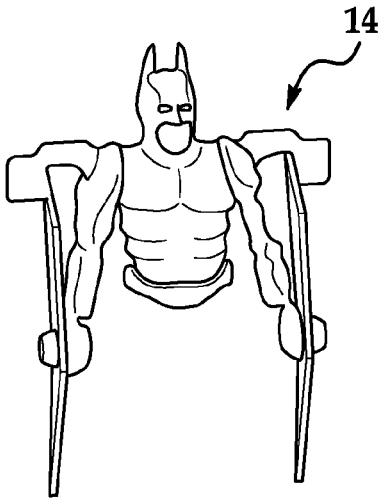
Figure 11O:
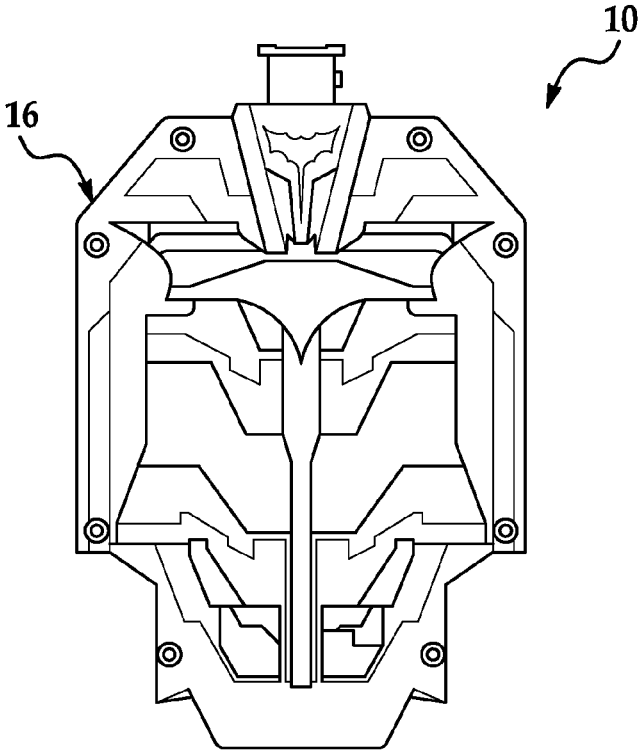
Figure 11P:
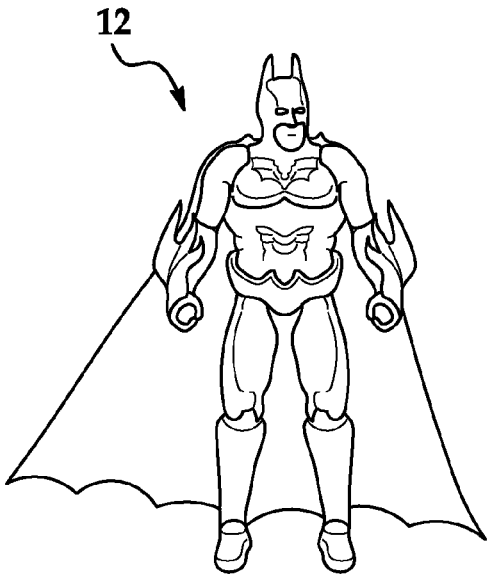
Figure 11Q:
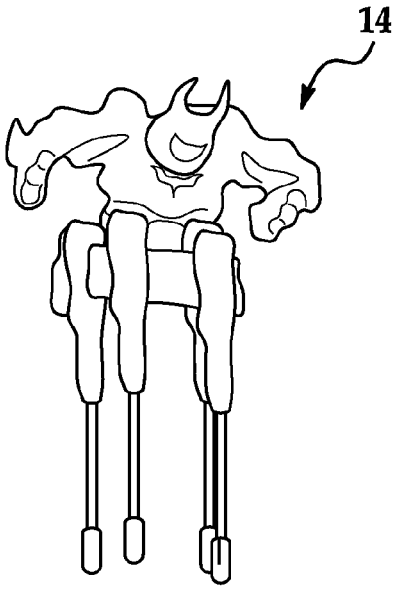
Figure 11R:
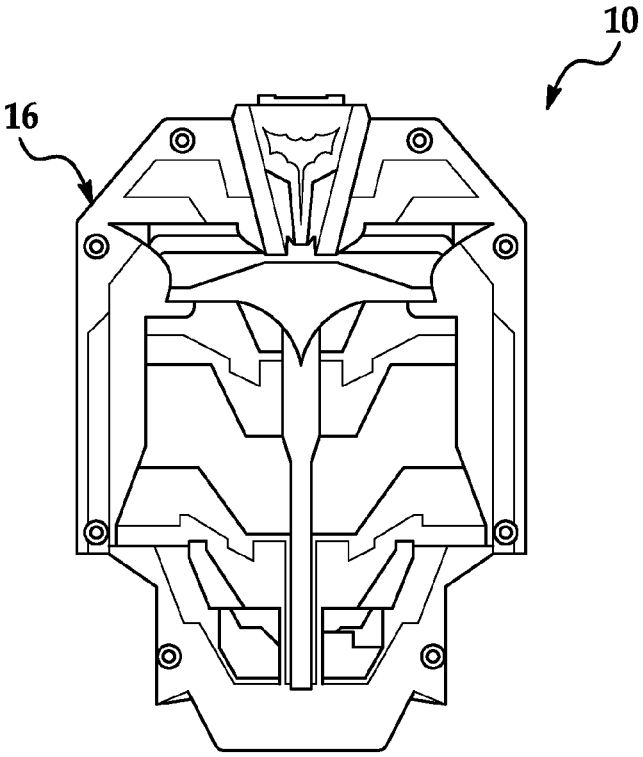

Although one configuration is illustrated in FIG. 6B, numerous other configurations of accessory 14 are contemplated to be within the scope of exemplary embodiments of the present invention. Some non-limiting examples are illustrated in FIGS. 11A-11R wherein some of the accessories are reconfigurable between a first position and a second position as they are inserted and removed from the interior cavity 36 of the housing 16 or alternatively the accessory 14 does not have deployable features.

Accordingly, a combination toy 10 is provided having an action figurine 12, an accessory 14 configured to be removably secured to the action figurine 12; and a housing 16 into which the action figurine 12 and the accessory 14 can be inserted so that a user can change the configuration of the action figurine 12. In one embodiment, the accessory 14 may be a weapon or armor that is applied to the action figurine 12 to make it ready for battle. Alternatively, the action figurine 12 may have an alter ego, wherein the accessory 14 changes the characteristic of the action figurine 12 (e.g., everyday citizen to superhero or villain, etc.).

As such and in one non-limiting embodiment, the housing 16 provides a chamber that allows an action figurine 12 to quickly change into and out of an accessory 14, which in one embodiment may resemble armor such that an armored figure may be slid into the chamber and a push of a first button may release only the action figurine while retaining the armor inside. Thereafter and once the action figurine is slid back into the chamber, the push of a second button may release both the action figurine clad in the armor. Still further and in some embodiments, the accessory or armor may include spring-loaded attachments that automatically open or expand when the armor is released from the chamber. Accordingly, numerous variations of play are provided in are considered to be within the scope of exemplary embodiments of the present invention.

The housing 16 is configured to releasably retain the accessory 14 and the action figurine 12 therein after they have been inserted into the housing 16. In one embodiment, the housing 16 has first means for releasing only the action figurine 12 from the housing 16 when the first actuation button 30 is depressed after the action figurine 12 and the accessory 14 have been previously inserted into the housing 16; and a second means for releasing both the action figurine 12 and the accessory 14 from the housing 16 when the second actuation button 34 is depressed and the action figurine 12 and the accessory 14 have been previously inserted into the housing 16.

In one embodiment, the housing 16 can be provided with a plurality of apertures 80 such that partial views into interior cavity 36 can be provided. Alternatively, the housing 16 can be configured to have no such apertures and thus very limited view into the interior cavity 36 other than opening 28.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A toy, comprising:

an action figurine;

an accessory configured to be removably secured onto the action figurine and configured to releasably engage a portion of the action figurine; and a housing having an interior cavity configured to accommodate both the action figurine and the accessory, the housing further comprising:

a first actuation member configured to selectively release the action figurine from the housing, wherein the first actuation member is coupled to a first moveable member configured to engage the action figurine when it is inserted into the housing; and a second actuation member configured to selectively release at least the accessory from the housing, wherein the second actuation member is coupled to a second moveable member, the second moveable member being configured to releasably engage a portion of the accessory;

wherein when the accessory is not removably secured onto the action figurine, the second actuation member releases only the accessory from the housing; and wherein when the accessory is removably secured onto the action figurine, the second actuation member releases both the accessory and the action figurine.

2. A toy, comprising:

an action figurine;

an accessory configured to be removably secured onto the action figurine and configured to releasably engage a portion of the action figurine; and a housing into which the action figurine and the accessory can be inserted, wherein the housing is configured to releasably retain the accessory and the action figurine therein after they have been inserted into the housing, the housing further comprising:

a first actuation mechanism for releasing the action figurine from the housing when the first actuation mechanism is actuated, wherein the action figurine becomes dislodged from the accessory, and the accessory remains within the housing; and a second actuation mechanism for releasing both the action figurine and the accessory from the housing when the second actuation mechanism is actuated;

wherein the first actuation mechanism is coupled to a first moveable member configured to engage the action figurine when it is inserted into the housing; and wherein the second actuation mechanism is coupled to a second moveable member, the second moveable member being configured to releasably engage a portion of the accessory.

3. The toy as in claim 2, wherein the accessory has a pair of deployable features mounted thereto for movement between a first position and a second position, the second position corresponding to a position for insertion of the accessory into the housing.

4. The toy as in claim 3, wherein the pair of deployable features of the accessory are spring biased into the first position and wherein the pair of deployable features are pivotally mounted to the accessory.

5. The toy as in claim 2, wherein the accessory has a mounting portion with a pair of features configured to slidably engage a pair of slots located within the housing.

6. The toy as in claim 2, wherein the second actuation mechanism is coupled to a second movable member being configured to engage a portion of the accessory.

7. The toy as in claim 2, wherein the first movable member is configured to engage only a head portion of the action figurine when it is inserted into the housing.

8. The toy as in claim 7, wherein the accessory is configured such that the first movable member passes through the accessory in order to engage the head portion of the action figurine when the first actuation mechanism is operated.

9. The toy as in claim 8, wherein the accessory has a pair of deployable features pivotally mounted thereto for movement between a first position and a second position, the second position corresponding to insertion of the accessory into the housing.

10. The toy as in claim 9, wherein the pair of deployable features of the accessory are spring biased into the first position.

11. The toy as in claim 10, wherein the accessory has a mounting portion with a pair of features configured to slidably engage a pair of slots located within the housing.

12. The toy as in claim 7, wherein the accessory has a mounting portion with a pair of features configured to slidably engage a pair of slots located within the housing.

13. The toy as in claim 8, wherein the accessory has a mounting portion with a pair of features configured to slidably engage a pair of slots located within the housing.

14. A toy, comprising:

an action figurine;

an accessory configured to be removably secured onto the action figurine; and a housing into which the action figurine and the accessory can be inserted, wherein the housing is configured to releasably retain the accessory and the action figurine therein after they have been inserted into the housing, the housing further comprising:

a first actuation mechanism for releasing the action figurine from the housing when the first actuation mechanism is actuated, wherein the action figurine becomes dislodged from the accessory, and the accessory remains within the housing; and a second actuation mechanism for releasing both the action figurine and the accessory from the housing when the second actuation mechanism is actuated;

wherein the first actuation mechanism is coupled to a first movable member configured to engage only a portion of the action figurine when it is inserted into the housing, the first movable member being configured for movement between a first position corresponding to insertion of the action figurine into the housing and a second position corresponding to removal of the action figurine from the housing, and wherein the second actuation mechanism is coupled to a second movable member configured for movement between a first position corresponding to insertion of the accessory into the housing and a second position corresponding to removal of the accessory from the housing, the second movable member being configured to releasably engage a portion of the accessory, wherein the accessory has a mounting portion with a pair of features configured to slidably engage a pair of slots located within the housing and the housing has a pair of retention members located within the pair of slots, the pair of retention members each having a feature spring biased to engage a portion of the second movable member after it has been moved from the second position to the first position, wherein movement of the second movable member from the first position to the second position must overcome a biasing force applied to the feature of each of the pair of retention members.

15. The toy as in claim 2, wherein the accessory has a mounting portion with a pair of features configured to slidably engage a pair of slots located within the housing and the pair of slots each have an enlarged opening with an angled surface to guide the pair of features into the pair of slots.

16. The toy as in claim 15, wherein the accessory has a pair of deployable features pivotally mounted thereto for movement between a first position and a second position, the second position corresponding to insertion of the accessory into the housing and wherein the pair of deployable features of the accessory are spring biased into the first position.

17. In combination, an action figurine, an accessory configured to be removably secured onto the action figurine; and a housing into which the action figurine and the accessory can be inserted, wherein the housing is configured to releasably retain the accessory and the action figurine therein after they have been inserted into the housing, the housing further comprising: a first means for releasing only the action figurine from the housing when a first actuation button is depressed and the action figurine and the accessory have been previously inserted into the housing; and a second means for releasing both the action figurine and the accessory from the housing when a second actuation button is depressed and the action figurine and the accessory have been previously inserted into the housing, wherein the first actuation button is coupled to the first means configured to engage the action figurine when it is inserted into the housing, and wherein the second actuation button is coupled to the second means, the second means being configured to releasably engage a portion of the accessory.

18. The combination of claim 17, wherein the accessory has a pair of deployable features pivotally mounted thereto for movement between a first position and a second position, the second position corresponding to insertion of the accessory into the housing and wherein the pair of deployable features of the accessory are spring biased into the first position.

19. The toy as in claim 2, wherein the first actuation mechanism is coupled to a first movable member configured to engage the action figurine when it is inserted into the housing, and wherein the second actuation mechanism is coupled to a second movable member, the second movable member being configured to engage the accessory.

* * * * *